US006993838B1

(12) United States Patent
Staffa et al.

(10) Patent No.: US 6,993,838 B1
(45) Date of Patent: Feb. 7, 2006

(54) COLLECTOR TUBE FOR A HEAT TRANSFER UNIT AND METHOD FOR PRODUCING SAME

(75) Inventors: Karl-Heinz Staffa, Stuttgart (DE); Hans-Joachim Krauss, Stuttgart (DE); Hagen Mittelstrass, Bondorf (DE); Christoph Walter, Stuttgart (DE); Bernd Dienhart, Cologne (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/936,567

(22) PCT Filed: Feb. 29, 2000

(86) PCT No.: PCT/EP00/01681

§ 371 (c)(1),
(2), (4) Date: Dec. 6, 2001

(87) PCT Pub. No.: WO00/55561

PCT Pub. Date: Sep. 21, 2000

(30) Foreign Application Priority Data

Mar. 15, 1999 (DE) ..... 199 11 334

(51) Int. Cl.
*F23P 15/26* (2006.01)
*F28F 9/02* (2006.01)

(52) U.S. Cl. ..... 29/890.052; 29/890.043; 165/173

(58) Field of Classification Search ..... 165/173, 165/175; 29/890.052, 890.043
See application file for complete search history.

(56) References Cited

U.S. PATENT DOCUMENTS

| | | | | |
|---|---|---|---|---|
| 3,204,663 A | * | 9/1965 | Taylor | 29/890.043 |
| 3,416,600 A | | 12/1968 | Fink | 165/175 |
| 5,052,480 A | | 10/1991 | Nakajima et al. | 165/153 |
| 5,088,193 A | * | 2/1992 | Okada et al. | 29/890.043 |
| 5,243,842 A | | 9/1993 | Kobayashi et al. | 72/51 |
| 5,622,220 A | | 4/1997 | Park et al. | |
| 5,743,329 A | | 4/1998 | Damsohn et al. | 165/174 |
| 5,868,198 A | | 2/1999 | Kato | 165/153 |

FOREIGN PATENT DOCUMENTS

| | | |
|---|---|---|
| DE | 43 34 203 | 4/1994 |
| DE | 196 01 276 | 7/1997 |
| DE | 196 49 129 | 5/1998 |
| DE | 197 29 497 | 1/1999 |
| DE | 197 40 114 | 3/1999 |

(Continued)

*Primary Examiner*—Leonard R. Leo
(74) *Attorney, Agent, or Firm*—Foley & Lardner LLP

(57) ABSTRACT

The invention relates to a collector tube (1) for a heat transfer unit. The tube comprises one or several slits (3*d*) on the periphery thereof, whereby said slits are formed by a punch press without an inner die or by high-pressure shaping for inserting a respective flat tube. The invention also relates to a method for producing said collector tube (1). According to the invention, a collector tube (1) is provided with an outer radius (D/2) to tube wall thickness (s) ratio of less than 5. The slits (3*d*) are introduced preferably parallel to, or at an acute 2 angle to the longitudinal axis of the tube. The collection tube can be produced by bending a flat material and subsequently sealing the longitudinal slits arising from the bending process by soldering or welding. Said collector tube can be used, e.g. for gas coolers and evaporators for $CO_2$ air conditioning systems in motor vehicles.

21 Claims, 2 Drawing Sheets

FOREIGN PATENT DOCUMENTS

| | | |
|---|---|---|
| EP | 0 198 581 | 4/1990 |
| EP | 0 533 574 | 3/1993 |
| EP | 0 757 928 | 2/1997 |
| EP | 0 761 336 | 3/1997 |
| EP | 0 845 647 | 6/1998 |
| EP | 0 845 648 | 6/1998 |
| EP | 0 900 605 | 3/1999 |
| WO | 95/17985 | 7/1995 |

* cited by examiner

COLLECTOR TUBE FOR A HEAT TRANSFER UNIT AND METHOD FOR PRODUCING SAME

BACKGROUND OF THE INVENTION

The invention relates to a header tube for a heat exchanger, with one or more slots for the insertion of a respective flat tube, said slots being introduced by punching with no inner die or by internal high-pressure forming, and to a method for the production of a header tube of this type. An important field of use is heat exchangers in the form of evaporators and condensers or gas coolers of motor vehicle air-conditioning systems.

Patent Specifications EP 0 198 581 B1 and U.S. Pat. No. 5,052,480 disclose header tubes, each with a row of transverse slots, into which are inserted flat-tube ends of a heat exchanger block constructed from flat tubes arranged in parallel. Due to the transverse position of the slots, the header tube diameter must be kept larger than the slot length. The header tubes have a tube-wall thickness which is smaller by a multiple than their diameter. Due, inter alia, to this small tube-wall thickness, as regards the header tubes of EP 0 198 581 B1, indentations of the header tube occur in the regions of the slots and form inwardly bent intrusions, the tube outside diameter being about one and a half times larger outside the slot region than in the slot region.

In a header tube production method described in the laid-open publication DE 43 34 203 A1, transverse slots in the form of inwardly bent intrusions are introduced into a header tube by punching assisted by an inner die, for which purpose an inner die is pushed into the header tube and the slots are punched into the header tube wall from outside by means of a suitable ram.

Alternatively to transverse slots, it is known to provide header tubes with slots which run parallel to or at an acute angle to the tube longitudinal axis and into which twisted flat-tube ends are inserted, see for example, Patent Specification U.S. Pat. No. 3,416,600 and the laid-open publications EP 0 845 648 A2 and DE 197 29 497 A1.

The technical problem on which the invention is based is to provide a header tube of the type mentioned in the introduction, which can be produced at relatively low outlay and is also suitable, in particular, for applications involving a high pressure load, such as for $CO_2$ air conditioning systems of motor vehicles, and an advantageous method for the production of such a header tube.

BRIEF SUMMARY OF PREFERRED EMBODIMENTS

The invention solves this problem by the provision of a header tube comprising one or more slots (3*a* to 3*d*) for the insertion of a respective flat tube, the slots being introduced by punching with no inner die or by internal high pressure forming, characterized in that the ratio (D/2s) of the tube outer radius (D/2) to the tube-wall thickness (s) is lower than five. The invention also solved this problem by provision of a method for the production of a header tube with one or more slots for a heat exchanger, said slots being introduced by punching with no inner die or by internal high-pressure forming, characterized in that the slot or slots (3*a* to 3*d*) are introduced parallel to or at an acute angle to the tube longitudinal axis (2) or by a method characterized in that characterized in that a flat piece (5) is bent into a header tube blank open along a longitudinal gap (8) and the longitudinal gap is subsequently sealingly soldered or sealingly welded, and the slot or slots (3*a* to 3*d*) are introduced into the flat piece (5) or into the header tube blank (6) before or after the longitudinal gap (8) is sealingly soldered or sealingly welded.

In the header tube mentioned above, the ratio of the tube outer radius to the tube-wall thickness has a value lower than five, that is to say, with respect to its tube outer radius, the header tube has a comparatively large tube-wall thickness which makes it suitable for applications involving a high pressure load, such as occur, for example, in motor vehicle air-conditioning systems which operate with $CO_2$ as refrigerant. In particular, tube-wall thicknesses of between 1.8 mm and 2.5 mm may be provided. The header tube with this large tube-wall thickness can be provided at relatively low outlay, by punching with no inner die or by internal high-pressure forming, with elongate slots, into which associated flat-tube ends of a heat exchanger can be inserted and can be sealingly soldered or secured in a gastight manner in another way.

In an advantageous development of the invention, a material with a hardness of between 35 $H_v$ and 80 $H_v$ is selected for the header tube.

In a further refinement of the invention, the slots are formed by inwardly bent instructions, in such a way that the ratio of the tube outside diameter outside the slot region to that in the slot region is between 1.02 and 1.5.

In the header tube production method, one or more slots are introduced into the header tube by punching with no inner die or by internal high-pressure forming and are oriented parallel to or at an acute angle to the header tube longitudinal axis. A header tube produced in this way is particularly suitable for heat exchangers, in which use is made of flat tubes with twisted ends which, as a result of the twisting, are oriented at a corresponding angle to the header tube longitudinal axis.

In the header tube production method, in order to form the header tube, first a flat piece, which may be solder-plated, if required, is bent into a blank, the longitudinal gap which has thereby remained being subsequently sealingly soldered or sealingly welded. The slots required for the insertion of heat exchanger flat tubes are introduced, by punching with no inner die, selectively either already into the flat piece or only into the blank bent out of the flat piece, before or after the longitudinal gap is sealingly soldered or sealingly welded.

In a further refinement of this production method, a solder-plated flat piece is used so that a correspondingly solder-plated header tube is then obtained, thus making it easier for the longitudinal gap and/or flat-tube ends inserted into the slots to be sealingly soldered. In a further refinement of this measure, the seal-soldering of the longitudinal gap is carried out in a common soldering operation, in which the remaining components of the heat exchanger are simultaneously soldered together, so that, overall, only one complete soldering operation is necessary for the manufacture of the heat exchanger.

In a further refinemnt of the header tube production method according to the invention, punctiform heat treatment and/or mechanical weakening is provided at the points on the header tube at which the slots are to be introduced, thus making it easier for the slots to be introduced with no inner die.

BRIEF DESCRIPTION OF THE DRAWINGS

Advantageous embodiments of the invention are illustrated in the drawings and are described below.

DETAILED DESCRIPTION OF PREFERRED EMBODIMENTS

Figure 1:
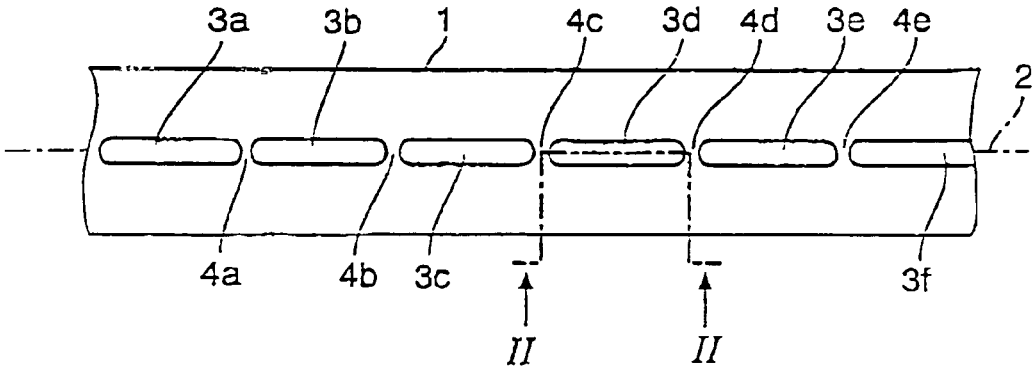
FIG. 1 shows a diagrammatic side view of a detail of a header tube with slots introduced parallel to the tube longitudinal axis.
Figure 2:
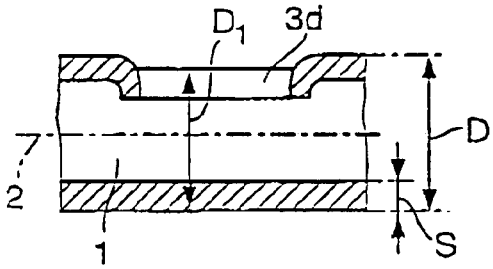
FIG. 2 shows a sectional view along the line II—II of FIG. 1.

The header tube 1 shown as a detail in FIGS. 1 and 2 is provided circumferentially, that is to say on its tube outer surface, with a row of slots 3*a*, 3*b*, 3*c*, 3*d*, 3*e*, 3*f* which succeed one another in the direction of the tube longitudinal axis 2 and have an elongate configuration matched to the cross-sectional shape of flat-tube ends to be inserted. Said slots run with their longitudinal extent parallel to the tube longitudinal axis or tube other surface line 2 and succeed one another at equal short intervals so as to form corresponding web regions 4*a*, 4*b*, 4*c*, 4*d*, 4*e*. It goes without saying that, if required, that is to say depending on the succession of flat-tube ends to be inserted of a heat exchanger flat-tube block configuration used in each case, and other succession of slots is possible, for example, a sequence of pairs of slots having a wider interval and each consisting of two closely adjacent slots.

The slots 3*a* to 3*f* can be introduced by means of a punching operation, in which the header tube 1 is surrounded by an outer die divided in two, the lower die half of which carries the header tube 1 and the upper die half of which has a corresponding number of slots which are arranged at intervals and through which associated punching rams penetrate and thereby "tear" the slots 3*a* to 3*f* into the header tube 1 as inwardly directed intrusions. Alternatively, the introduction of the slots may also be carried out partially by means of suitable rams and also with the header tube 1 being guided only partially on the outer circumference. As can be seen in more detail from FIG. 2, owing to the inwardly bent-round intruded slots 3*a* to 3*f*, the header tube 1 has in the respective slot region a tube outside diameter $D_1$ which is smaller than the tube outside diameter D outside the slot regions, that is to say level with the webs 4*a*, 4*b*, 4*c*. The term "outside diameter" is in this case to be understood in the wide sense as designating in general the transverse extent, even in the case of noncircular cross-sectional shapes. It is shown that the "tearing" or punching of the slots 3*a* to 3*f* should preferably be carried out in such a way that the ratio of the tube outside diameter D outside the slot regions to the tube outside diameter D1 in the slot regions is between about 1.02 and about 1.5. The introduction of the slots 3*a* to 3*f* may be influenced or facilitated by the header tube 1 previously being heat-treated in a punctiform manner at the respective points or by mechanical weakening of the tube wall being provided at these points. As a further alternative manufacturing method, the slots may also be introduced by means of internal high-pressure punching.

As is also evident from FIG. 2, the header tube 1 has a relatively large wall thickness s in relation to its diameter D, so that it is also suitable for applications involving a high pressure load. The header tube 1 can therefore also be used, in particular, for heat exchangers such as evaporators and gas coolers, of $CO_2$ air-conditioning systems which are increasingly provided for use in motor vehicles. The tube-wall thickness s is typically larger than 1.0 mm and is preferably in the range of between about 1.3 mm and 2.5 mm. With respect to the tube outside diameter D or to the tube radius D/2, it proves advantageous if the ratio D/2s or the tube radius D/2 to the tube-wall thickness s is kept lower than five and is preferably between about two and five. Furthermore, it proves beneficial to select a material for the header tube with a material hardness of between about 35 $H_v$ and about 80 $H_v$, in particular for use in a heat exchanger of a $CO_2$ air-conditioning system.

Associated flat-tube ends, in particular flat-tube ends twisted through 90°, may be inserted into the slots 3*a* to 3*f* in a way known per se and be connected in a gastight manner. For this purpose, the slots 3*a* to 3*f* may be provided with suitable tube introduction slopes, thus making it easier to receive a gastight connection by means of a subsequent seal soldering operation. For seal-soldering, the header tube may be solder-plated or suitable solder preforms may be used. The prior solder-plating of the header tube may be carried out according to a current plating method or else by means of a CD method or by galvanizing. Alternatively, the slots introduced into the header tube may also be introduced into the header tube without an inwardly directed intrusion region and without introduction sloping. Depending on the tube-wall thickness and tube strength and on the moment of resistance during the introduction of the slots 3*a* to 3*f*, a more or less pronounced deformation forming an intrusion is formed parallel to the tube extent and, due to its trough shape, keeps the solder in the region to be soldered, when the flat-tube ends inserted into the slots 3*a* to 3*f* are being sealingly soldered. The seal-soldering of the inserted flat tube ends may be carried out in a single soldering operation in which, at the same time, the entire construction, for example a tube/rib block construction and the associated exchanger is soldered together. By means of this manufacturing method, both flat tube condensers or flat tube gas coolers and evaporators of given types can be produced, for example those with a block consisting of rectilinear or of serpentine flat tubes. Suitable header tubes of the present type are then in each case arranged laterally on the block in order to distribute the refrigerant of the air-conditioning system to the flat tubes and to collect it from the flat tubes.

Figure 3:
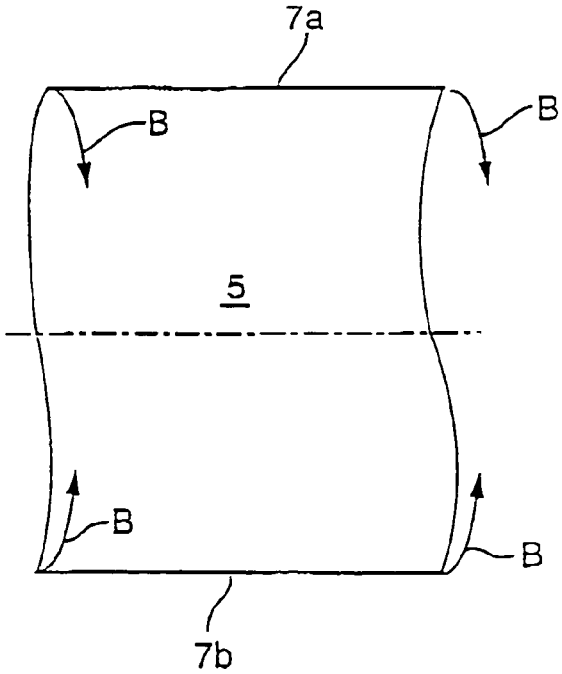
FIG. 3 shows a top view of a detail of a flat piece which can be used for producing the header tube of FIG. 1.
Figure 4:
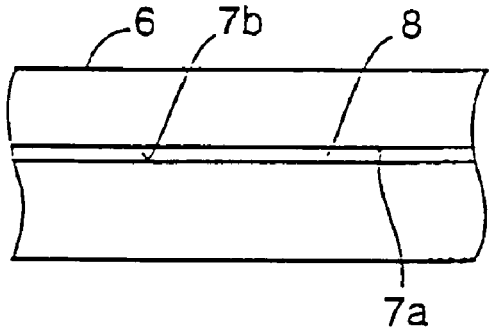
FIG. 4 shows a side view of the header tube blank obtained by bending round the flat piece of FIG. 3.

The header tube 1 may be manufactured, as an initially unplated header tube blank, by drawing and subsequent optional plating. Another manufacturing method is illustrated in FIGS. 3 and 4. In this type of production, the flat tube 1 is manufactured from a flat material 5, which, if desired, may already be solder-plated. As illustrated in FIG. 3 by bending arrow B, the flat piece 5 is bent parallel to its longitudinal axis 5*a* into a round-tube blank, shown in FIG. 4. As is also evident from FIG. 4, where the round-tube blank 6 is concerned, the two previous flat-piece longitudinal sides 7*a*, 7*b* are located opposite one another so as to form a narrow longitudinal gap 8. The longitudinal gap 8 is then closed in a gastight manner by welding or soldering in a subsequent manufacturing step. The seal-soldering of the longitudinal gap 8 is carried out by means of flux in a special soldering operation or in a common operation together with the seal-soldering of flat-tube ends which are inserted into slots in the blank 6 functioning in the finished state as a header tube. In particular, a single complete soldering operation may be provided, in which the soldered connections and also all the other soldered connections of the components necessary for constructing a corresponding heat exchanger are made. The insertion slots for the flat-tube ends may, depending on the application, be introduced already into the flat piece 5 or only into the round-tube blank 6 before or after the gastight closing of the longitudinal gap 8. In this case, the row of slots, as is shown in FIG. 1 is preferably located diametrically opposite the longitudinal gap 8.

Instead of the row, shown in FIG. 1, of slots introduced in the tube longitudinal direction and in a longitudinal mid-plane of the header tube 1, the elongate slots required for the insertion of flat-tube ends may also be introduced in another way, for example as eccentric slots, which are introduced, offset laterally to the longitudinal mid-plane or outer surface line of the header tube or as inclined slots, which are introduced, inclined at an angle of more than 0° and less than 90° to the tube outer surface line or longitudinal mid-plane of the header tube. By the tube ends thereby issuing into the header tube not transversely to the tube longitudinal direction, but parallel to or at an inclination to the latter, the inside diameter of said header tube can be kept smaller than the flat-tube width. This is conducive to the stability of the header tube under pressure and, as compared with flat tubes entering transversely, makes it possible to have a reduction in volume of the header tube and consequently of the refrigerant quantity necessary for the air-conditioning system.

Figure 5:
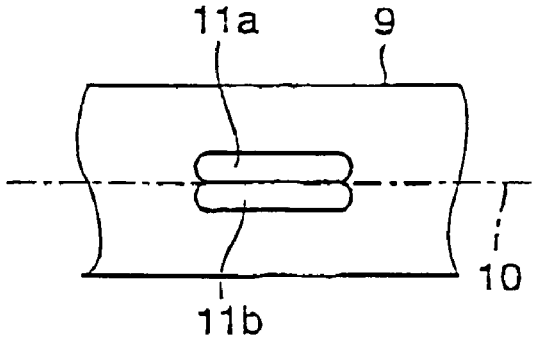
FIG. 5 shows a side view of a detail of a header tube with two slots lying circumferentially in contact next to one another.

A further variant is illustrated in FIG. 5. In the header tube 9 shown as a detail there, two circumferentially adjacent slots 11*a*, 11*b* are provided, which are combined to form a corresponding double slot in that they are longitudinally in contact with one another along the tube outer surface line 10. Two flat-tube ends lying closely against one another can be inserted into this double slot in a gastight manner. As a further alternative slot configuration, a row of slots similar to that of FIG. 1 is provided, in which, however, the slots are not arranged at intervals from one another but butt with their narrow sides against one another.

Figure 6:
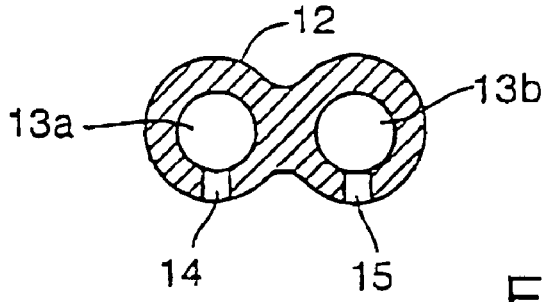
FIG. 6 shows a cross-sectional view of a header tube with two separate longitudinal header ducts.

Apart from the circular cross section, other header tube cross sections are also possible, depending on the application, for example a rectangular or square, semicircular or oval cross section. Moreover, the header tube according to the invention can be implemented not only as a single-chamber tube that is to say with a single distributing or collecting space, but also as a multichamber tube. Thus, FIG. 6 shows as an example a two-chamber tube 12 which contains two longitudinal ducts 13*a*, 13*b* separated from one another. Two rows of slots 14, 15 lying next to one another are introduced into the two-chamber tube 12, each row of slots being configured according to that of FIG. 1 or one of the variants mentioned above in this respect and issuing in each case into one of the two longitudinal ducts 13*a*, 13*b*.

As a further embodiment of the invention, a header tube may be provided, the tube interior of which is divided by one or more transverse partitions into a plurality of collecting spaces which succeed one another in the tube longitudinal direction and into which issue in each case one or more flat-tube ends which are inserted sealingly into associated header tube slots.

What is claimed is:

1. A method for manufacturing a header for a heat transfer apparatus, comprising:

providing a tube having an outside diameter (D), and outside radius (D/2), and a wall thickness (s);

punching the tube without an internal die (i) to form a slot in the tube, (ii) to provide a tube having a ratio (D/2:s) of the tube's outside radius (D/2) to the tube wall thickness (s) of less than 5, and (iii) to provide a tube having a ratio (D:D1) of the tube outside diameter (D) outside of the region of the slot to the tube diameter in the region of the slot (D1) of between 1.02 and 1.5 spot heat treating and/or mechanically weakening the tube in the region to be punched before the step of punching.

2. A method according to claim 1, wherein the step of providing a tube comprises:

providing a flat material having a first longitudinal side and a second longitudinal side;

bending the flat material so that the first longitudinal side and the second are adjacent to one another and define a longitudinal gap; and closing the longitudinal gap by welding or soldering.

3. A method according to claim 2, wherein, in addition to the step of closing the longitudinal gap by welding or soldering, the method further comprises welding or soldering a plurality of joints for the construction of the heat transfer apparatus, and wherein the step of closing the longitudinal gap and the step of welding or soldering the plurality of joints takes place in a single welding or soldering step.

4. A method according to claim 1, wherein the flat material comprises a solder-plated flat material.

5. A method according to claim 1, wherein the step of punching comprises internal, high-pressure punching.

6. A header produced by the method of claim 1.

7. A heat transfer apparatus comprising a flat tube and a header according to claim 6.

8. A motor vehicle comprising a heat transfer apparatus according to claim 7.

9. A header for a heat transfer apparatus, comprising:

a tube having an outside diameter (D), a wall thickness (s) and an outside radius (D/2); and a slot for the insertion of a flat tube;

wherein a ratio (D/2:s) of the tube's outside radius (D/2) to the tube wall thickness (s) is less than 5, and wherein a ratio (D:D1) of the tube outside diameter (D) measured outside the region of the slot to the tube outside diameter (D1) measured in the region of the slot is between 1.02 and 1.5.

10. A header according to claim 9, wherein the header comprises a material having a hardness between 35 Hv and 80 Hv.

11. A header according to claim 9, wherein the tube comprises a non-circular cross section.

12. A header according to claim 11, wherein the tube comprises a rectangular, square, semicircular or oval cross section.

13. A header according to claim 9, wherein the tube comprises a plurality of chambers.

14. A header according to claim 9, wherein the tube comprises one or more transverse partitions.

15. A header according to claim 9, wherein the tube comprises a weld or seal-solder seam.

16. A header according to claim 9, wherein the slot is arranged at an angle of more than 0 degrees to less than 90 degrees with respect to a longitudinal mid-plane of the tube.

17. A header according to claim 9, further comprising a mechanical weakening provided at place at which the slot was made.

18. A header according to claim 9, wherein the header comprises a plurality of slots.

19. A header according to claim 18, wherein the header comprises at least two circumferentially adjacent slots.

20. A heat transfer apparatus comprising a flat tube and a header according to claim 9.

21. A motor vehicle comprising a flat tube and a header according to claim 20.

* * * * *